United States Patent [19]

Rieck

[11] 4,393,994

[45] Jul. 19, 1983

[54] ELECTROMAGNETIC FUEL INJECTOR WITH FLEXIBLE DISC VALVE

[75] Inventor: Gerald C. Rieck, Sterling Heights, Mich.

[73] Assignee: General Motors Corporation, Detroit, Mich.

[21] Appl. No.: 251,466

[22] Filed: Apr. 6, 1981

[51] Int. Cl.[3] ..... B05B 1/30

[52] U.S. Cl. ..... 239/585; 251/129

[58] Field of Search ..... 239/585; 251/129, 138, 251/DIG. 3

[56] References Cited

U.S. PATENT DOCUMENTS

| | | | |
|---|---|---|---|
| 2,619,986 | 12/1952 | Goepfrich | 251/129 |
| 2,881,980 | 4/1959 | Beck et al. | 239/585 X |
| 3,926,405 | 12/1975 | Arnold | 251/129 |
| 4,231,525 | 11/1980 | Palma | 239/585 |

*Primary Examiner*—John J. Love
*Assistant Examiner*—Paul A. Sobel
*Attorney, Agent, or Firm*—Arthur N. Krein

[57] ABSTRACT

An electromagnetic fuel injector includes an electromagnet actuated flexible disc valve that is biased toward a closed position in seating engagement with an associate valve seat by a spring associated with the armature of a solenoid and is biased toward an open position relative to the valve seat by an opposed spring upon energization of the electromagnet.

3 Claims, 2 Drawing Figures

ELECTROMAGNETIC FUEL INJECTOR WITH FLEXIBLE DISC VALVE

FIELD OF THE INVENTION

This invention relates to electromagnetic fuel injectors and, in particular, to a flexible disc valve and armature arrangement for such injectors.

DESCRIPTION OF THE PRIOR ART

Electromagnetic fuel injectors are used in fuel injection systems for vehicle engines because of the capability of this type injector to effect the discharge of a precise metered quantity of fuel per unit of time to an engine. Such injectors normally contain an electromagnetic coil which, when energized, is operative to effect axial movement of an armature. Normally the armature is mechanically connected to a valve that is movable relative to a valve seat for controlling fuel injection.

As is well known, such injectors normally require very close manufacturing tolerances to obtain concentricity of parts for effecting proper seating of the valve and to obtain other desired structural relationships effecting fuel metering, fuel spray patterns and the durability of the injector.

However, in one such type electromagnetic fuel injector as disclosed, for example, in U.S. Pat. No. 4,218,021, entitled Electromagnetic Fuel Injector, issued Aug. 19, 1980 to James D. Palma, and which is presently in use on commercially available passenger vehicles, a two-part valve means movable relative to an annular valve seat is used to open and close a passage for the delivery of fuel from the injector out through an injection nozzle having delivery orifices downstream of the valve seat. One part of this valve means is a sphere-like valve member having a flat on one side thereof and being spherical opposite the flat to provide a spherical seating surface for valve closing engagement with the valve seat. The other part of the valve means is an armature with a flat end face seated against the flat surface of the valve member in a laterally slidable engagement therewith. With this arrangement, the valve member is thus free to be self-centering relative to the valve seat.

In this latter type injector, a first spring is positioned to normally bias the armature in a direction to effect seating of the valve member against the valve seat. Preferably, a second spring is positioned on the downstream side of the valve seat to assist in effecting opening movement of the valve member relative to the valve seat when the armature is moved axially in an opposite direction against the bias of the first spring and to couple the valve to the armature. This second spring is thus positioned between the valve orifice, defined by the annular space between the valve member and its valve seat during an injector stroke, and the delivery orifice, which in this particular type injector is defined by a plurality of director passages provided in a swirl director plate located downstream of the valve element, that is downstream in terms of the direction of fuel flow through the injector nozzle.

SUMMARY OF THE INVENTION

A primary object of the present invention is to provide an improved electromagnetic fuel injector which can be advantageously utilized in a relatively low pressure fuel system, such as 10 psi fuel system, for a gasoline engine and which includes a two-part movable valve means, including a flexible disc valve and an armature to control fuel injection.

Accordingly, another object of the invention is to provide an improved electromagnetic fuel injector wherein a two-part valve means, used to control fuel injection, includes a spring biased armature of a solenoid actuator and a separate flexible disc valve for cooperation with an upstanding valve seat, an opposed spring being positioned to effect unseating of the disc valve upon energization of the solenoid actuator.

Still another object of the injection is to provide an improved electromagnetic fuel injector that advantageously utilizes a spring biased armature of a solenoid actuator to normally bias a flexible disc valve into seating engagement with an associate valve seat and an opposed spring to effect unseating of the disc valve upon energization of the solenoid actuator.

A further object of the invention is to provide an improved electromagnetic fuel injector having a retainer which is adapted to hold an otherwise flat disc valve in flexed position for movement relative to an associated upstanding annular valve seat.

Still another object of the present invention is to provide an electromagnetic fuel injector of the above type which includes features of construction, operation and arrangement, rendering it easy and inexpensive to manufacture and to assemble, which is reliable in operation, and in other respects suitable for extended use on production motor vehicle fuel systems.

The present invention provides an electromagnetic fuel injector having an injector nozzle at one end thereof, the injector nozzle having a discharge passage means therethrough including a discharge orifice means at one end and an annular upstanding valve seat encircling the opposite end of the passage means in relatively closely spaced relationship to the discharge passage means. A two-part valve means is movable relative to the valve seat to control fuel flow out through the discharge passage means. One part of the valve means is a flexible disc valve that is normally flexed into valve closing engagement with the valve seat; the second part being a spring biased armature with a central stem for abutment against the disc valve to effect its seating engagement with the valve seat. An opposed spring is positioned to effect unseating of the disc valve relative to the valve seat upon energization of the solenoid actuator causing the armature to move in an axial direction away from the valve seat.

For a better understanding of the invention, as well as other objects and further features thereof, reference is had to the following detailed description of the invention to be read in connection with the accompanying drawings.

DESCRIPTION OF THE EMBODIMENT

Figure 1:
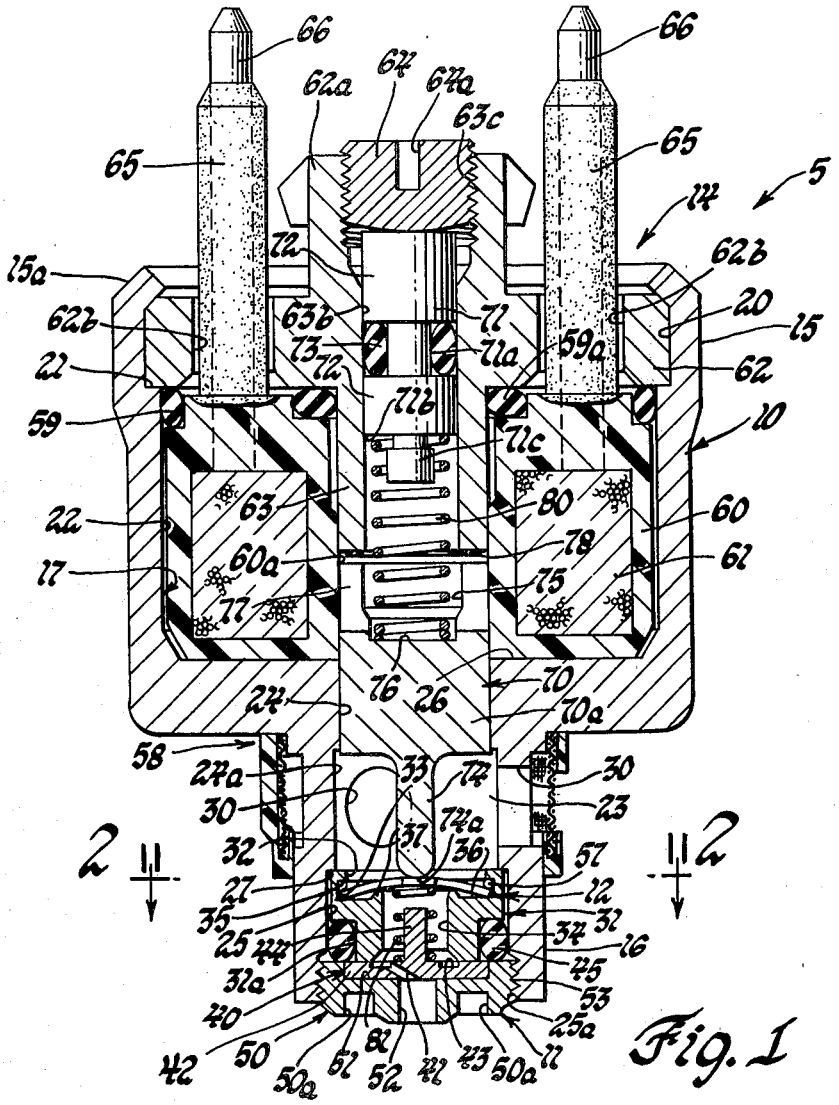
FIG. 1 is an enlarged, longitudinal, cross-sectional view of an exemplary embodiment of an electromagnetic fuel injector having a preferred embodiment of a disc valve means and an armature in accordance with the invention, incorporated therein, for controlling flow through a low volume fuel injector nozzle, the armature spring adjustment pin and disc valve member of the assembly being shown in elevation.

Referring first to FIG. 1, an electromagnetic fuel injector, generally designated 5, includes as major components thereof a body 10, a nozzle assembly 11, a valve member, which in accordance with a feature of the invention is a disc valve 12 and, a solenoid assembly 14 used to control movement of the disc valve 12.

In the construction illustrated, the body 10, is of circular hollow tubular configuration and is of such external shape so as to permit direct insertion, if desired, of the injector 5 into a socket provided for this purpose in either an engine intake manifold, not shown, or in the injector mechanism of a throttle body injection apparatus, not shown, for an engine.

The body 10, includes an enlarged upper solenoid case portion 15 and a lower end nozzle case portion 16 of reduced external diameter relative to portion 15. An internal cylindrical cavity 17 is formed in the body 10 by a stepped vertical bore therethrough that is substantially coaxial with the axis of the body.

In the construction shown, the cavity 17 provides a cylindrical upper wall 20, a cylindrical upper intermediate wall 22, a cylindrical lower intermediate wall 24 and a cylindrical lower wall 25. Such walls 20, 22 and 24 are of progressively reduced diameters relative to the wall next above, while the lower wall 25 is of enlarged diameter relative to wall 24 for a purpose to be described. In the construction shown, the cylindrical wall 24 is of stepped diameters whereby to provide an upper portion 24 of a diameter to slidably receive the large diameter portion 70*a* of an armature 70, to be described in detail hereinafter, and a lower cylindrical wall portion 24*a* of a diameter greater than the wall portion 24 but less than that of lower wall 25. Walls 20 and 22 are interconnected by a shoulder 21. Walls 22 and 24 are interconnected by a shoulder 26. Walls 24 and 25 are interconnected by a shoulder 27.

Wall portion 24*a* defines the outer peripheral extent of a fuel chamber 23, to be described in greater detail hereinafter, within the body 10. The body 10 in the construction shown, is preferably provided with three, circumferentially equally spaced apart, radial port passages 30 in the nozzle case portion 15 thereof which open through the wall 24*a* to effect flow communication with the fuel chamber 23.

The injection nozzle assembly 11, mounted in the lower nozzle case portion 16 of body 10, includes a seat element 31, a swirl director 40 and a spray tip 50 and as such is similar to the injection nozzle assembly used in the injector disclosed in the aboveidentified U.S. Pat. No. 4,218,021, the disclosure of which is incorporated herein by reference thereto.

In the embodiment shown, the seat element 31 is provided with a central axial stepped bore to provide a discharge passage therethrough defined by cylindrical walls, which in the construction illustrated, includes upper wall 32, intermediate wall 33 and a lower wall 34. Walls 32 and 34 are of reduced diameters relative to wall 33. Walls 32 and 33 are interconnected by flat shoulder 35. Walls 33 and 34 are interconnected by a shoulder 36 which includes an upstanding annular valve seat 37. The valve seat 37 is formed concentric with and encircles the upper end of the discharge passage defined by the lower wall 34.

The swirl director 40 is provided with a plurality of circumferentially, equally spaced apart, inclined and axially extending director passages 41 that extend through the upper cylindrical flange portion 42 of the swirl director. Preferably, six such passages are used, although only one such passage is shown in FIG. 1. These director passages 41, of predetermined equal diameters, extend at one end downward from an annular groove 43 provided on the upper surface radially outboard of a circular boss 44 that is integrally provided of the swirl director 40 so as to extend vertically upward loosely in the discharge passage defined by bore wall 34.

In the embodiment shown, the spray tip 50 is formed with a stepped bore therethrough to define an upper cylindrical surface 51 of an inside diameter to receive the swirl director 40 and a straight passage which serves as a combined swirl chamber-spray orifice passage 52 for the nozzle assembly. As shown, the lower end of each director passage 41 in the swirl director 40 is positioned so as to effect discharge of fuel into the spray orifice passage 52.

In the construction shown, the outer peripheral surface of the spray tip 50 is provided with external threads 53 for mating engagement with the internal threads 25*a* provided in the lower end of the body 10. The lower face of the spray tip 50 is provided, for example, with at least a pair of diametrically opposed blind bores 50*a*, of a size so as to slidably receive the lugs of a spanner wrench, not shown, whereby rotational torque may be applied to the spray tip 50 during assembly and axial adjustment of this element in the body 10 to the position shown, a position at which the upper surface of seat element 31 abuts against shoulder 27.

An O-ring seal 45 is operatively positioned to effect a seal between the seat element 31 and the wall 25. In the construction shown in FIG. 1, the seat element 31 is provided with an external reduced diameter wall 31*a* adjacent to its lower end to receive the O-ring seal 45.

Figure 2:
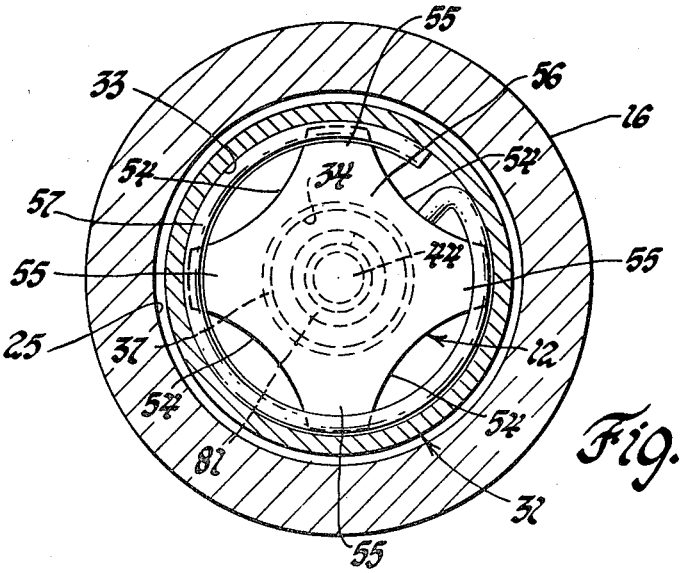
FIG. 2 is an enlarged sectional view of the injector of FIG. 1, taken along line 2—2 of FIG. 1 showing details of the disc valve and its retainer ring.

Now in accordance with a feature of the subject invention, flow through the discharge passage defined by wall 34 in seat element 31 is controlled by the disc valve 12. Disc valve 12, made of a suitable flexible material, such, for example, thin sheet brass or stainless steel, is preferably formed as a flat disc and then deformed when operatively assembled to the nozzle assembly 11. Preferably, to increase flexibility, the disc valve 12, of a predetermined external diameter, is of somewhat clover-leaf like in configuration, as shown in FIG. 2, and is formed with a plurality of radial inward extending arcuate grooves 54 to thus define a plurality of circumferentially spaced apart flexible fingers 55 that thus extend radially outward from a main body portion 56 of the disc valve 12. Although any suitable number of such flexible fingers 55 may be used, as desired, in the embodiment illustrated, disc valve 12 is formed with four such flexible fingers 55.

The disc valve 12 is assembled in the seat element 31, by first flexing it into a shallow dish shape and then positioning it in the cavity defined by intermediate wall 33. This flexed shallow dish shape, in effect, can be established, as desired by the predetermined selection of the axial height of valve seat 37 above the surface of shoulder 36 of seat element 31. A suitable retainer, such as split ring retainer 57 of suitable diameter, is then inserted into the cavity so that this retainer will be engaged beneath the shoulder 35 to prevent movement thereof in one axial direction, that is, up with reference to FIG. 1. The disc valve 12 is thus loosely retained so that it is capable of being flexed so that its main body portion 56 can be moved into and out of seating engagement relative to valve seat 37. As shown in FIG. 2, ring retainer 57 is of a predetermined diameter whereby it is adapted to abut against the outer peripheral top portions of the fingers 55 and to abut against the shoulder 35 of the disc valve 12 whereby to trap it in the seat element 31 while still permitting movement of this disc valve relative to valve seat 37.

The retainer ring 57 is thus adapted to normally maintain the disc valve 12 in a flexed position whereby the body portion 56 thereof is located over the valve seat 37 and normally in seating engagement therewith during engine operation due to the differential pressure across this element and due to the "oilcan" preload thereon by its having been flexed to the position shown during its assembly to the seating element 31.

To effect filtering of the fuel being supplied to the injector 5 prior to its entry into the fuel chamber 23, there is provided a fuel filter assembly, generally designated 58. The fuel filter assembly 58 is adapted to be suitably secured, as for example by predetermined press fit, to the body 10 in position to encircle the radial port passages 30 therethrough.

The solenoid assembly 14 of the injector 5 includes a tubular coil bobbin 60 supporting a wound wire coil 61. Bobbin 60 is positioned in the body 10 between the shoulder 26 thereof and the lower surface of a circular, radial flange portion of a pole piece 62 that is slidably received at its outer peripheral edge within the wall 20. Pole piece 62 is axially retained within body 10, as by having its flange portion sandwiched between the shoulder 21 and the radially inward spun over upper rim 15*a* of the body. Seals 59 and 59*a* are used to effect a seal between the wall 22 and the upper end of bobbin 60 and between the upper end of bobbin 60 and the surfaces of pole piece 62.

Formed integral with the pole piece 62 and extending centrally downward from the flange portion thereof is a tubular pole 63. Pole 63 is of a suitable external diameter so as to be slidably received in the stepped bore aperture 60*a* that extends coaxially through the bobbin 60. The pole 63, as formed integral with the pole piece 62, is of a predetermined axial extent so as to extend a predetermined axial distance into the bobbin 60 in axial spaced apart relation to, for example, the shoulder 27 of body 10. The pole piece 62, in the construction illustrated, is also provided with an upstanding central boss 62*a* that is radially enlarged at its upper end for a purpose which will become apparent.

Pole piece 62 and its integral pole 63 are formed with a central through stepped bore 63*b*. The cylindrical annular wall, defined by the bore 63*b* is provided at its upper end within the enlarged portion of boss 62*a*, with internal threads 63*c*. An adjusting screw 64, having a suitable tool receiving aperture 64*a*, for example, at its upper end, is adjustably threadedly received by the threads 63*c*.

The flange portion of pole piece 62 is also provided with a pair of diametrically opposed circular through slots 62*b* that are located radially outward of boss 62*a* so as to receive the upright circular studs 65 of bobbin 60. Each such stud 65 has one end of a terminal lead 66 extending axially therethrough for connection to a suitable controlled source of electrical power, as desired. The opposite end, not shown, of each such lead 66 is connected, as by solder, to a terminal end of coil 61. The terminal end, not shown, of coil 61, the studs 65, and of the through slots in the pole piece 62 are located diametrically opposite each other whereby to enhance the formation of a more uniform and symmetrical magnetic field upon energization of the coil 61 to effect movement of the cylindrical armature 70 upward without any significant side force thereon to thereby eliminate tilting of the armature.

A cylindrical spring force adjustment pin 71, made of suitable non-magnetic material, is provided with axially spaced apart enlarged diameter upper end portions whereby to define axially spaced apart cylindrical lands 72 that are of a diameter whereby they are guidingly received in bore 63*b* of the pole piece 63. The enlarged upper end of this pin 71 is positioned to abut against the lower rounded surface of the adjusting screw 64.

A suitable seal, such as an O-ring seal 73, is sealingly engaged against a wall portion of the pole 63 defining bore 63*b* and a reduced diameter portion 71*a* of the pin 71 between the lands 72.

The armature 70 of the solenoid assembly 14 is of cylindrical configuration with an upper portion 70*a* of an outside diameter whereby this armature is slidably received within the lower guide portion of the bore aperture 60*a* of bobbin 60 and a central depending reduced diameter portion 74 terminating at a semi-spherical tip 74*a*. As will be apparent, intermediate wall 24 is preferably of an internal diameter greater than that of bore aperture 60*a* so that axial movement of the armature 70 will be guided solely by its sliding engagement in the wall defined by the bore aperture 60*a* within bobbin 60.

As shown in FIG. 1, armature 70 is formed with a stepped central blind bore to provide an upper spring cavity portion defined by an internal cylindrical upper stepped wall 75 of a suitable predetermined inside diameter that terminates at a flat shoulder 76. In addition, the armature 70 at its upper end is provided with at least one central radial extending through narrow slot 77 formed at right angles to the axis of the armature.

As shown in FIG. 1, the armature 70, of predetermined axial extent, is slidably positioned for vertical axial movement between a lowered position, the position shown, at which its tip 74*a* abuts against the upper surface of disc valve 12 to additionally force this valve into positive seating engagement with the valve seat 37 and, a raised position at which the upper flat end of the armature 70 abuts against a non-magnetic shim 78, preferably fixed, as by diffusion bonding, to the lower end face of pole 63. Shim 78 is used to provide a minimum fixed air gap between the pole 63 and the armature 70 when the latter is in its raised position. When the armature 70 is in its lowered position, a working air gap is established between the lower end of the pole 63 and the upper end of the armature 70, as shown in FIG. 1.

Armature 70 is normally biased to its lowered position, as shown, with the disc valve 12 forced thereby into seating engagement against the valve seat 37, by means of a coiled return spring 80 which is of a predetermined force value. Spring 80 is suitably received at one end in the spring cavity within the armature 70 for abutment against shoulder 76 and at its other end it abuts against a radial shoulder 71*b* of adjustment pin 71. The return spring 80 is thus positioned to encircle the lower reduced diameter end 71*c* of the pin 71.

To effect unseating of the disc valve 12 from the valve seat 37, there is provided an opposed compression valve spring 81 that is loosely received in the passage defined by wall 34 in seat element 31 so as to loosely encircle boss 44 of swirl director 40. Valve spring 81 is thus positioned so that one end thereof, its lower end with reference to FIG. 1, abuts against the upper surface of the flange portion 43 of swirl director 40 while its opposite end abuts against the lower central surface of the body portion 56 of disc valve 12.

It should now be apparent to those skilled in the art that the forces of springs 80 and 81 are preselected relative to each other and to the pressure differential which will exist across the disc valve 12 during operational use of the electromagnetic fuel injector 5 in a particular engine application. As will be apparent, the pressure differential across the disc valve 12 will depend on the pressure of fuel being supplied to the fuel chamber 23 of the injector and the effective pressure that will exist in the passage defined by wall 34 during engine operation. For example, if this latter passage is closely associated in a particular engine with intake manifold pressure, then sub-atmospheric pressure will exist in this passage during engine operation.

It should also now be apparent that the force of the valve spring 81 must be suitably less than the force of the return spring 80, so that when the coil 61 is not energized, the return spring 80, acting through the armature 70, can effect movement of the main body portion 56 of the disc valve 12 downward, with reference to FIG. 1, into positive seating engagement with the valve seat 37. However, the force of the valve spring 81 must be selected so that, when the coil 61 is energized to effect upward movement of the armature 70 against the bias of the return spring 80, this valve spring 81 will effect upward movement of the disc valve, and specifically, the main body portion 56, to effect its unseating relative to the valve seat 37.

It will be appreciated that the unseating movement of the disc valve relative to the valve seat 37 and specifically its maximum travel will be limited by the corresponding upward movement of the armature 70 as the solenoid coil 61 is energized. For example, if the air gap or axial extent between the lower flat end of the core 63 and the upper flat end of the armature 70, when the latter is in its lowered position as shown, is approximately 0.006 inch and, if the thickness of the shim 78 is for example 0.002 inch then the axial extent of movement of the armature 70 upon energization of the solenoid will be approximately 0.004 inch. It will thus be apparent that in this example, the maximum unseating movement of the disc valve 12 relative to the valve seat 37 will be approximately 0.004 inch.

By the use of a suitable flexible valve member, in the manner disclosed herein, it will be apparent that precise positions of such a valve member relative to the valve seat 37 is not required. Furthermore, since the armature 70 is separated from the valve member, the concentricity of this element and in particular of the semi-spherical tip 74*a* thereof relative to the valve seat 37 is not critical to the operation of the subject valve assembly.

It should be appreciated by those skilled in the art that the disc valve 12 is functionally similar to a reed valve. Accordingly, although a particular configuration of the disc valve 12 is illustrated and described herein, it will be apparent that alternate forms of reed valves can be substituted for the disc valve 12. Specifically, cantilever type reed valves of suitable configuration which would be adapted at their free end to overlie and move relative to the valve seat 37 could be substituted for the disc valve 12 shown without departing from the scope of the invention as defined by the following claims.

The embodiments of the invention in which an exclusive property or privilege is claimed are defined as follows:

1. An electromagnetic fuel injector including housing means providing a fuel chamber therein intermediate its ends adapted to receive fuel and which has an upstanding annular valve seat therein encircling a discharge passage from said chamber through which fuel is to be ejected; a flexed flexible valve means having spaced apart fingers positioned in said fuel chamber and adapted to be vertically flexed relative to said valve seat to open and close said passage; a solenoid means operatively supported in said housing means, said solenoid means including an axial movable armature positioned to engage one side of said valve means opposite said valve seat and, a valve-closing spring positioned to act on said armature in an axial direction whereby said valve means is forced by said armature into seating engagement with said valve seat; and, a valve-opening spring disposed in said discharge passage and positioned to abut against the opposite side of said valve means to effect unseating of said valve means from said valve seat when said solenoid means is energized.

2. An electromagnetic fuel injector including housing means providing a fuel chamber therein intermediate its ends adapted to receive fuel and which has an upstanding annular valve seat encircling a discharge passage from said chamber through which fuel is injected to an engine; a flexible disc valve, of clover-like configuration and flexed into a shallow dish shape operatively positioned in said fuel chamber and adapted to be vertically flexed relative to said valve seat to open and close said passage; a solenoid means operatively supported in said housing means, said solenoid means including a movable armature positioned to engage one side of said disc valve opposite said valve seat and a valve-closing spring positioned to act on said armature in a direction whereby said disc valve is flexed by said armature to its closed positioned relative to said valve seat; and, a valve-opening spring operatively disposed in said discharge passage and bearing against the opposite side of said disc valve in an opening direction relative to said valve seat.

3. An electromagnetic fuel injector including housing means providing a fuel chamber therein intermediate its ends adapted to receive fuel, and a passage from said chamber through which fuel is injected to an engine; said housing means defining an annular valve seat upstanding into said fuel chamber and encircling said passage where it communicates with said chamber; a flexible valve means; retainer means operatively associated with said housing means and said valve means to operatively position said valve means for movement relative to said valve seat whereby to open and close said passage, said flexible valve means being of shallow dish shape configuration as positioned by said retainer means and thus flexed into normal closing engagement with said valve seat; a solenoid means operatively supported in said housing means, said solenoid means including a movable armature positioned to engage one side of said valve means opposite said valve seat and, a valve-closing spring positioned to act on said armature in a direction whereby said valve means is flexed by said armature to its closed position relative to said valve seat; and, a valve-opening spring operatively disposed in said passage and bearing against the opposite side of said valve means in an opening direction relative to said valve seat, said valve-opening spring having a preselected force less than the force of said valve-closing spring.

* * * * *